US007022212B2

(12) United States Patent
Zdunek

(10) Patent No.: US 7,022,212 B2
(45) Date of Patent: Apr. 4, 2006

(54) MICRO STRUCTURED ELECTRODE AND METHOD FOR MONITORING WAFER ELECTROPLATING BATHS

(75) Inventor: Alan D. Zdunek, Chicago, IL (US)

(73) Assignee: American Air Liquide, Inc., Fremont, CA (US)

( * ) Notice: Subject to any disclaimer, the term of this patent is extended or adjusted under 35 U.S.C. 154(b) by 557 days.

(21) Appl. No.: 10/277,178

(22) Filed: Oct. 21, 2002

(65) Prior Publication Data

US 2003/0111346 A1 Jun. 19, 2003

Related U.S. Application Data

(60) Provisional application No. 60/348,360, filed on Oct. 26, 2001.

(51) Int. Cl.
*G01N 27/26* (2006.01)

(52) U.S. Cl. ..... 204/400; 204/407; 204/434; 204/280; 204/416; 422/82.01; 422/82.02; 422/82.03; 422/98

(58) Field of Classification Search ..... 204/400, 204/407, 412, 433, 434, 435, 280; 422/82.03, 422/82.01, 82.02, 98
See application file for complete search history.

(56) References Cited

U.S. PATENT DOCUMENTS 5,118,403 A * 6/1992 Magee et al. ..... 204/400

* cited by examiner

*Primary Examiner*—Bruce F. Bell
(74) *Attorney, Agent, or Firm*—Christopher J. Cronin

(57) ABSTRACT

A microstructured electrode coupled with an analytical method designed to simulate the actual conditions on the wafer and to measure critical parameters such as mass transfer of the active plating components, deposition rates of the copper in the plating bath solutions, and/or additive concentration is disclosed. Thus, an offline method for process control is provided. Additionally, the electrode and method can be incorporated into a copper interconnect bath tool or copper interconnect bath distribution system for online control of the process chemistry. The microstructured electrode design consists of a patterned electrode surface that simulates the dimensions of the interconnects and vias. The analytical method can be any type of method that allows diffusion or kinetic information to be obtained, such as electrochemical impedance, electrochemical noise, and other voltammetric or galvanostatic methods.

16 Claims, 5 Drawing Sheets

MICRO STRUCTURED ELECTRODE AND METHOD FOR MONITORING WAFER ELECTROPLATING BATHS

CROSS REFERENCE TO RELATED APPLICATION

This application claims the benefit of U.S. Provisional Application No. 60/348,360, filed Oct. 26, 2001.

BACKGROUND OF THE INVENTION

1. Field of the Invention

This invention relates to a micro structured electrode and method for monitoring wafer electroplating baths that permits in situ monitoring of the electrodeposition process during the manufacture of micro structured electrodes, typically for use in the semiconductor industry.

2. Description of Prior Art

The semiconductor industry is replacing aluminum and tungsten with copper as the conductive material for chip interconnects and vias. The current technology for depositing copper onto the wafer is by an advanced electroplating method that utilizes specially designed plating cells and plating baths that enable copper deposition into the small geometries used in chip manufacturing. The baths consist of a solution of copper sulfate, sulfuric acid, chloride, and other additives, called levelers, brighteners, and accelerators, that enhance the deposition process. Maintaining the additives in a specific range is critical to defect-free copper deposition.

For example, Robertson, et al., Galvanostatic Method for Quantification of Organic Suppressor and Accelerator Additives in Acid Copper Plating Baths, suggests that the concentration of the organic additives in the plating bath is important to the success of void-free metal deposition. Describing a proposed method of bath condition analysis, a pulsed cyclic galvanostatic analysis (PCGA) is based on the measurement of the plating overvoltage as a function of the additive concentration, and relies on the use of a nucleate pulse.

Kelly, et al., Leveling and Microstructural Effects of Additives for Copper Electrodeposition, 146 J. Electrochemical Soc., 2540–2549 (1999), discloses the role of two model additives in the deposition of copper from an acid-copper sulfate electrolyte.

In Bratin, et al., Control of Damascene Copper Processes by Cyclic Voltammetric Stripping, Semiconductor Fabtech, $12^{th}$ Edition, the shift from aluminum to copper as the metal of choice in chip interconnects for the semiconductor industry is disclosed. The reference further suggests that organic additives are useful to control the uniformity of copper deposition, and that very close control of the additive levels in the copper bath is required.

Lindner, Microfabricated Potentiometric Electrodes and Their in Vivo Applications, Analytical Chemistry, May 1, 2000, discloses microelectrodes used in biology and medicine. These microelectrodes are not microstructured, but are rather flat, micro-sized devices.

Dionex, Analysis of Copper Plating Baths, an industry brief indicating that it was presented at the 1998 Semicon Southwest Int'l Electronics Mfg. Symposium, suggests the shift from aluminum to copper as the metal of choice in chip interconnects for the semiconductor industry. The article further suggests that, for microelectronics, an acid copper sulfate plating solution is optimal due to its high throwing power. This article then goes on to describe a copper bath analysis method using ion and high performance liquid chromatography.

In sales literature, Technic, Inc. describes its RTA as an automated, online, real-time, in situ system for monitoring and controlling the chemical composition of baths at its website, http://www.technic.com/resrch/rta.htm. This equipment purports to offer a single instrument that can be operated remotely without extensive operator training. U.S. patents of interest in this regard include U.S. Pat. Nos. 5,391,271, 5,336,380, 5,324,400, 5,320,724, 5,298,131, 5,298,130, 5,298,129, 5,296,124, 5,296,123, and 4,631,116.

Thus, frequent measurement of the additive concentrations is needed to maintain the proper bath concentrations of the additives. Currently, this is done by electrochemical techniques, such as (1) cyclic voltammetric stripping (CVS), presently utilized by ECI Technology in laboratory and online equipment; (2) pulsed cyclic galvanostatic analysis (PCGS), presently sold by ATMI; and (3) alternating current voltammetry (AC voltammetry), presently sold by Technic, Inc. in its RTA™ analyzer.

These methods were developed for printed circuit board plating applications as offline analytical measurements, but recently have been incorporated into online monitoring equipment and connected to the copper interconnect plating bath distribution system. They utilize planar, metal electrodes and potential versus current scans to calculate additive concentrations. Presently, a disadvantage of these techniques is that they take too much time to obtain a measurement, sometimes up to two hours for one additive concentration. This is due to the additional preparation and calibration required with the multi-component plating bath solution. Another problem associated with these methods is that the reliability and accuracy of the measurements are insufficient for the integrated circuit manufacturing industry. Often, the measurement signal drifts and frequent maintenance of the electrodes is needed. In addition, it is not clear how the bulk additive concentration levels or degradation products from the plating process correlate with the deposition rate of the copper and the onset of defects and voids in the interconnects and vias. It is believed that the mass transfer characteristics of the additives plays a crucial role in the copper deposition and may be a more important measure of the condition of the bath.

Thus, a problem associated with methods for monitoring wafer electroplating baths that permits in situ monitoring of the electrodeposition process during the manufacture of metallic interconnects is that they require too much time to prepare and operate, and thus cannot communicate environment conditions quickly enough to be optimally useful.

Yet another problem associated with methods for monitoring wafer electroplating baths that permits in situ monitoring of the electrodeposition process during the manufacture of metallic interconnects is that they are not easily prepared, and therefore require greater skill and knowledge during the preparation of the monitoring process.

Still a further problem associated with methods for monitoring wafer electroplating baths that permits in situ monitoring of the electrodeposition process during the manufacture of metallic interconnects is that they require a difficult calibration, and are therefore susceptible to human error and/or machine error.

An even further problem associated with methods for monitoring wafer electroplating baths that permits in situ monitoring of the electrodeposition process during the manufacture of metallic interconnects is that they are not sufficiently reliable, and can lead to process errors that are detrimental to the manufacturing process.

Another problem associated with methods for monitoring wafer electroplating baths that permits in situ monitoring of the electrodeposition process during the manufacture of metallic interconnects is that they are not sufficiently accurate to provide data that effectively minimizes the production variances to an acceptable level in the semiconductor field.

For the foregoing reasons, there has been defined a long felt and unsolved need for a method for monitoring wafer electroplating baths that permits in situ monitoring of the electrodeposition process during the manufacture of metallic interconnects that seeks to overcome the problems discussed above, while at the same time providing a simple, easily used method for monitoring wafer electroplating baths and a microstructured electrode manufactured thereby.

SUMMARY OF THE INVENTION

A microstructured electrode design used as an in situ or offline monitoring device and coupled with an analytical method to more accurately and quickly simulate conditions in copper interconnect plating bath solutions.

Currently, the semiconductor industry relies on offline, once-a-day measurements in the laboratory to determine additive concentrations in a copper deposition bath. These data are reported to the process engineer and the proper adjustments to the bath are made on a daily basis. With the increasing use of copper interconnect deposition in the production of semiconductors, daily, offline monitoring will no longer provide the precision required to effect adequate process control of plating bath conditions. Moreover, current electrochemical monitoring methods are too slow.

The present invention comprises a microstructured electrode coupled with an analytical method designed to simulate the actual conditions on the wafer and to measure critical parameters such as mass transfer of the active plating components, deposition rates of the copper in the plating bath solutions, and/or additive concentration. The invention can therefore be used as an offline method for process control, and can also be incorporated into a copper interconnect bath tool or copper interconnect bath distribution system for online control of the process chemistry. The microstructured electrode design consists of a patterned electrode surface that simulates the dimensions of the interconnects and vias. The analytical method can be any type of method that allows diffusion or kinetic information to be obtained, such as electrochemical impedance, electrochemical noise, and other voltammetric or galvanostatic methods.

It is therefore an object of the present invention to provide a method for monitoring wafer electroplating baths that permits in situ monitoring of the electrodeposition process during the manufacture of metallic interconnects that can be prepared and operated quickly, and can therefore communicate environment conditions quickly enough to be optimally useful.

Yet another object of the present invention is to provide a method for monitoring wafer electroplating baths that permits in situ monitoring of the electrodeposition process during the manufacture of metallic interconnects that is easily prepared, thereby requiring less skill and knowledge during the preparation of the monitoring process.

Still a further object of the present invention is to provide a method for monitoring wafer electroplating baths that permits in situ monitoring of the electrodeposition process during the manufacture of metallic interconnects that requires little or no calibration, and is therefore less susceptible to human error and/or machine error.

Another object of the present invention is to provide a method for monitoring electroplating baths that simulates actual conditions of the interconnect deposition process during the manufacture of the metallic interconnects.

An even further object of the present invention is to provide a method for monitoring wafer electroplating baths that permits in situ monitoring of the electrodeposition process during the manufacture of metallic interconnects that is sufficiently reliable and minimizes production errors during the manufacturing process.

Another object of the present invention is to provide a method for monitoring wafer electroplating baths that permits in situ monitoring of the electrodeposition process during the manufacture of metallic interconnects that is sufficiently accurate to provide data that effectively minimizes the production variances to an acceptable level in the semiconductor field.

These and other objects, advantages and features of the present invention will be apparent from the detailed description that follows.

DESCRIPTION OF THE DRAWINGS

In the detailed description that follows, reference will be made to the following figures:

FIG. 7(*b*) illustrates a schematic view of an analytical cell for use in an in situ method for monitoring wafer electroplating baths;

FIG. 7(*c*) illustrates a schematic view of a second analytical cell for use in an in situ method for monitoring wafer electroplating baths;

FIG. 7(*d*) illustrates a schematic view of a plating bath for use in an in situ method for monitoring wafer electroplating baths;

DETAILED DESCRIPTION OF THE PREFERRED EMBODIMENTS

Figure 1:
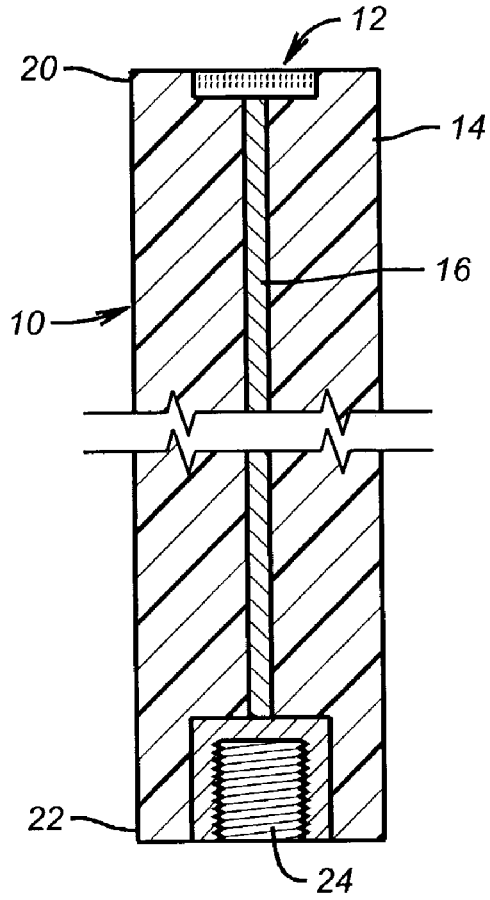
FIG. 1 illustrates a cross-sectional view of a microstructured electrode constructed and arranged with a patterned electrode.

As shown in FIG. 1, a cross-sectional view of a microstructured electrode 10 is shown having a patterned electrode 12. The patterned electrode 12 is located at a first end 20 of the microstructured electrode 10 and is generally centered within the cylindrical shape of the microstructured electrode 10. A non-conductive sheath 14 surrounds an electrical wire 16 which is operatively associated with the patterned electrode 10 and monitoring equipment (now shown). At a second end 22 of the microstructured electrode 10, a metal, threaded connector 24 is provided.

Figure 2:
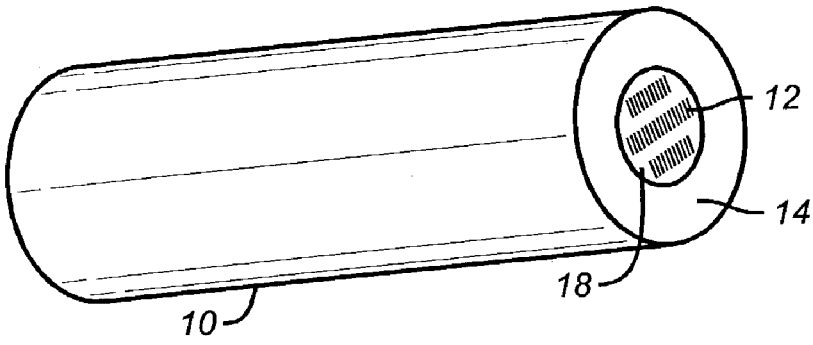
FIG. 2 illustrates a side plan view of the microstructured electrode shown in FIG. 1.

FIG. 2 illustrates a side plan view of the microstructured electrode 10. The non-conductive sheath 14 surrounds the patterned electrode 12 axially but permits a face 18 of the electrode 12 to remain exposed.

Figure 3:
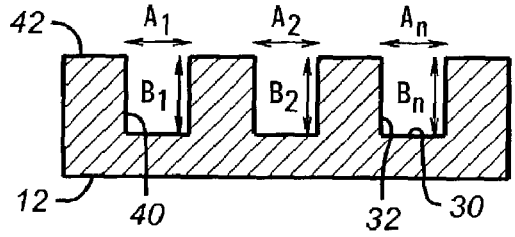
FIG. 3 illustrates a schematic view of a segment of the patterned electrode shown in FIG. 1 illustrating a geometry thereof.

As illustrated in FIG. 3, a schematic view of a segment of the patterned electrode 12 is provided. A geometry of the electrode 12 is shown having trenches 30 and wall portions 32 having sidewalls 40 and top faces 42. The trench widths $A_1$, $A_2$, $A_n$ are between about 0.1 microns to about 100 microns, and are preferably between about 0.1 microns and about 2.0 microns. Note that, as technology advances, these widths will become smaller and smaller, and widths substantially less than about 0.1 microns are to be expected.

These widths can be uniform throughout the length of the electrode 12 or they can vary. Likewise, the wall portion height $B_1$, $B_2$, $B_n$ are between about 0.1 microns and about 100 microns, and are preferably between about 0.5 microns and about 20 microns. Preferably, the wall heights are between about 5 times and about 40 times greater than the trench widths. The wall heights, too, can be uniform throughout the length of the electrode 12 or they can vary. The number of trenches (n) can range from 1 to 1000, and is preferably between about 50 and about 200.

Figure 4:
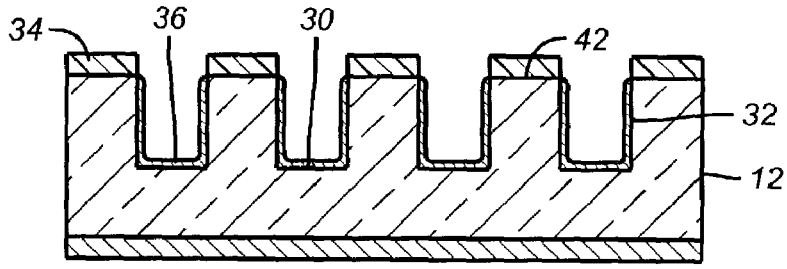
FIG. 4 illustrates a side plan view of a segment of a patterned electrode illustrating a first embodiment thereof.

A side plan view of a segment of a patterned electrode 12 constructed from a silicon wafer is shown in FIG. 4. A non-conductive layer or mask 34 is provided along the top face 42 of the wall portions 32. A copper seed layer 36 is provided in the trench 30 and extends upward along the sidewall 40 of the wall portion 32.

Figure 5:
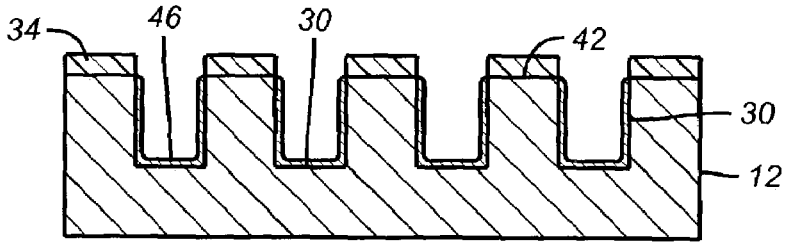
FIG. 5 illustrates a side plan view of a segment of a patterned electrode illustrating a second embodiment thereof.

FIG. 5 illustrates a side plan view of a segment of a patterned electrode 12 constructed from a micromachined metal disk. A non-conductive layer or mask 34 is provided along the top face 42 of the wall portions 32. A copper deposit layer 46 is provided in the trench 30 and extends upward along the sidewall 40 of the wall portion 32.

Figure 6:
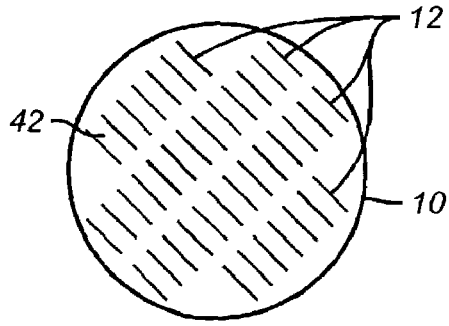
FIG. 6 illustrates a top view of a micropatterned electrode.
Figure 7A:
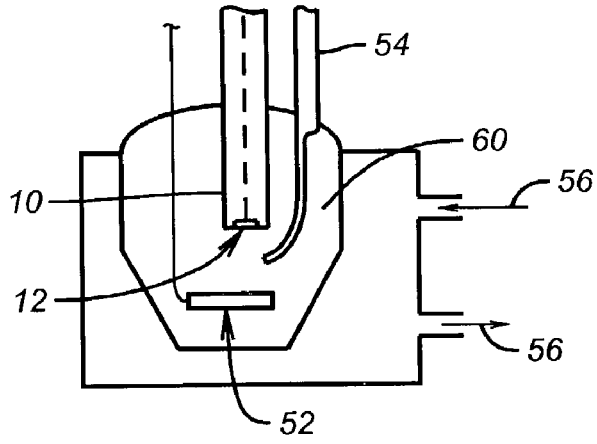
FIG. 7(*a*) illustrates a schematic view of an analytical cell for use in an ex situ method for monitoring wafer electroplating baths.
Figure 7B:
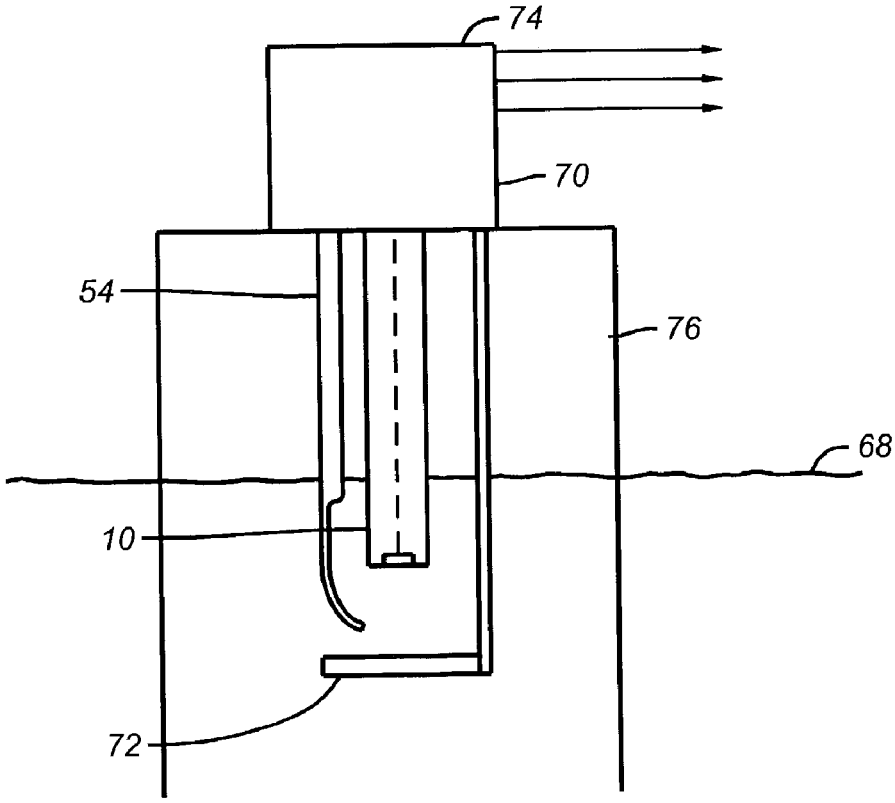
Figure 7C:
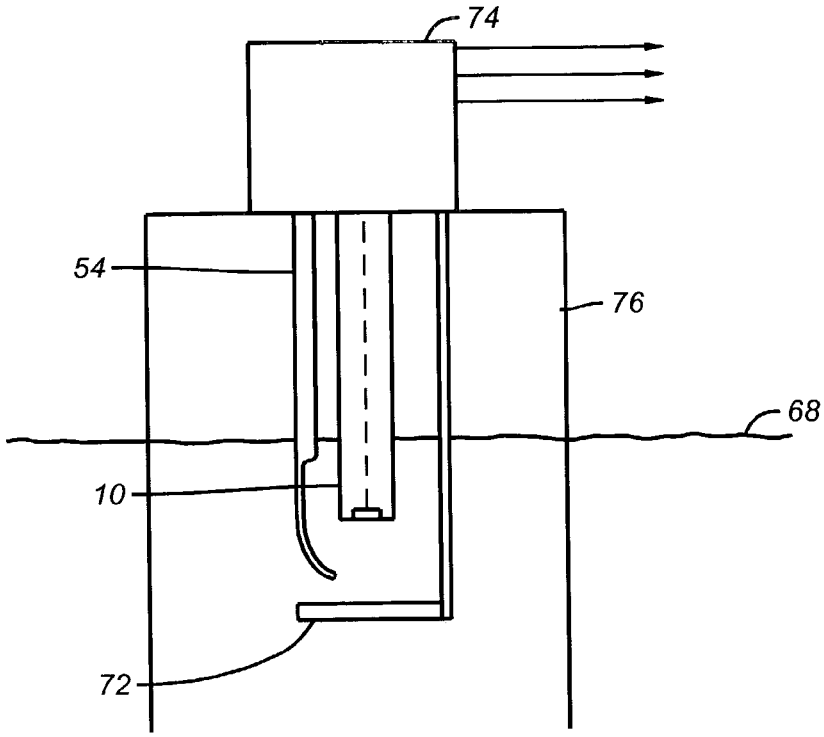
Figure 7D:
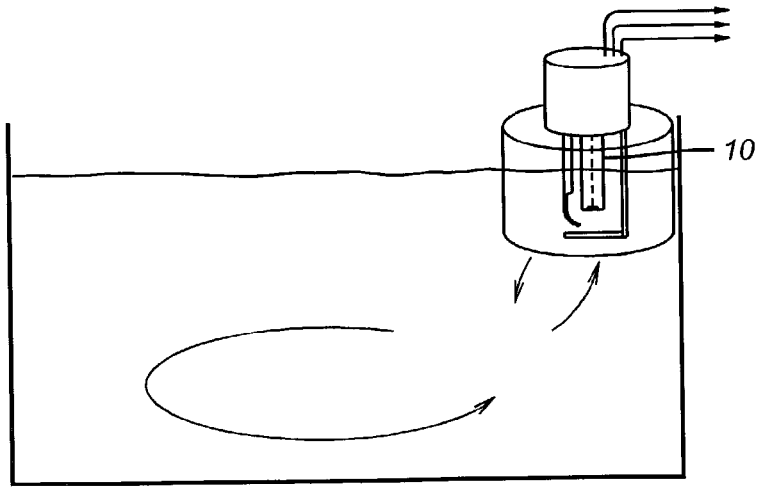

As shown in FIG. 6, a top view of a microstructured electrode 10 shows multiple rows of patterned electrodes 12. As illustrated, the top faces 42 of the wall portions can be seen.

FIG. 7(*a*) illustrates a schematic view of an analytical cell 50 for use in an ex situ method for monitoring wafer electroplating baths (not shown). A microstructured electrode 10 is immersed in bath solution 60, and can be rotated if desired to achieve more uniform readings. The rate of rotation typically is between about 100 rpm and about 3000 rpm, and is preferably between about 1500 rpm and about 2000 rpm. An anode 52 is provided for electrochemical measurements and/or deposition. A reference electrode 54 is provided for potentiostatic control. A water temperature bath 56 can be provided for temperature control, as desired.

Similarly, an in situ microstructured electrode 10 is shown in FIG. 7(*b*), and is provided with rotation of the microstrucured electrode 10. This provides a method for in situ monitoring of wafer electroplating baths. A reference electrode 54 is provided for potentiostatic control. A counter electrode 72 is positioned beneath the electrode 10. A motor 70 provides means for rotating the electrode 10 in the bath and is surrounded by an electrical connection housing 74. A protective sheath 76 is provided around the housing 74. The electrolyte level of immersion 68 is monitored.

An in situ microstructured electrode 10 is shown in FIG. 7(*c*), without rotation of the microstrucured electrode 10. This provides a simpler method for in situ monitoring of wafer electroplating baths. A reference electrode 54 is provided for potentiostatic control. A counter electrode 72 is positioned beneath the electrode 10. An electrical connection housing 74 is provided. A protective sheath 76 is provided around the housing 74. The electrolyte level of immersion 68 is monitored.

FIG. 7(*d*) illustrates the apparatus 10, as described by either FIGS. 7(*b*) or 7(*c*), as immersed in either a plating bath, or reservoir tank, or blending tank or tank in the chemical delivery unit, to best approximate process conditions and permit in situ monitoring of the manufacturing process.

Thus, as described and illustrated, the microstructured electrode 10 is constructed and arranged to emulate the conditions of the microstructured electrode being manufactured, and is thereby operatively associated, either ex situ or in situ, in solution from the wafer electroplating baths to transmit data that enables the operator to determine the conditions in the bath.

Figure 8A:
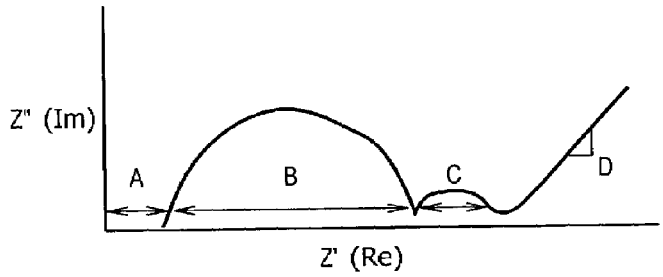
FIG. 8 illustrates a graphical representation of analytical methods that can be utilized in a method for monitoring wafer electroplating baths.
Figure 8B:
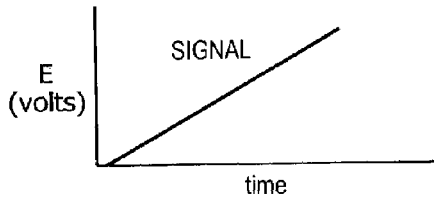
Figure 8C:
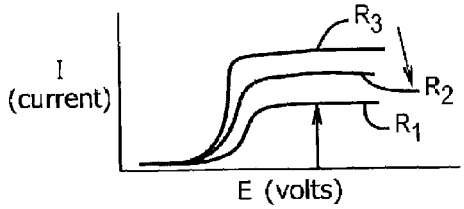

In FIG. 8, graphical representations of data for use in analytical methods for monitoring wafer electroplating baths are shown. Specifically, FIG. 8(*a*) illustrates a conceptual graph of data to be expected, which is useful to interpreting the process conditions in the manufacturing process. Thus, the data shown can be interpreted as is generally known in the art. As shown in FIG. 8, graphical representations of electrochemical impedance spectroscopy data for monitoring wafer electroplating baths are shown. Electrochemical impedance spectroscopy, or EIS, is a common method used in electrochemical characterization. EIS is a steady-state technique capable of observing phenomena in electrochemical systems whose relaxation times vary over many orders in magnitude. The EIS technique applies a small-amplitude sinusoidal voltage, typically 5–100 millivolts, to a working electrode at a number of discrete frequencies, typically from 0.001 to 100,000 Hertz. At each of these frequencies, the resulting current exhibits a sinusoidal response, $I(\omega)$, that is out-of-phase with the applied sinusoidal voltage signal. The electrochemical impedance, termed $Z(\omega)$, is actually the frequency-dependent proportionality factor that acts as a transfer function between the voltage signal and current response:

$$Z(\omega)=V(\omega)/I(\omega)$$

$Z(\omega)$ is a complex-valued vector quantity with real and imaginary components, whose values are frequency-dependent:

$$Z(\omega)=Z'(\omega)+j\,Z''(\omega),$$

where $Z'(\omega)$ is the real component of the impedance and $Z''(\omega)$ is the imaginary component of the impedance. The real and imaginary impedance can be plotted against each other at each frequency to generate a "Nyquist" plot and the familiar semicircle shapes as shown in FIG. 8(*a*).

Specifically, FIG. 8(*a*) illustrates a conceptual graph of data to be expected plotting the real impedance versus the imaginary impedance. Solution resistance and coating resistance/capacitance are normally observed at the higher frequency range (Point A), corrosion resistance, or reaction rates are observed in the mid frequencies (Points B and C), and diffusion phenomena occur at the lower frequencies (Point D). See, e.g., R. Varma and J. R. Selman, Techniques for Characterization of Electrodes and Electrochemical Processes, Chapter 11, pp. 515–647, John Wiley & Sons, 1991.

FIG. 8(*b*) illustrates the expected voltage produced as a function of time, indicating that the signal would be expected to increase linearly. FIG. 8(*c*) illustrates three voltage curves as a function of current (I) for three rates of rotation $R_1$, $R_2$, $R_3$ of the microstructured electrode whereby $R_1$. is less than $R_2$, which is less than $R_3$.

FIG. 8(*b*) illustrates the imposed voltage produced as a function of time in a potentiodynamic polarization measurement. The signal would be expected to increase linearly with time. FIG. 8(*c*) illustrates the resulting current from the voltage signal. Three voltage curves as a function of current (I) are shown. Each curve contains a current plateau that is a function of solution flow and mass transfer limitation of the electrolyte solution. See, e.g., D. T. Sawyer, A. Sobkowiak, J. L. Roberts Jr., Electrochemistry for Chemists, pp. 57–59, John Wiley & Sons, 1995 2nd Edition for further explanation of the data to be expected according to FIGS. 8(*b*) and 8(*c*).

Figure 9A:
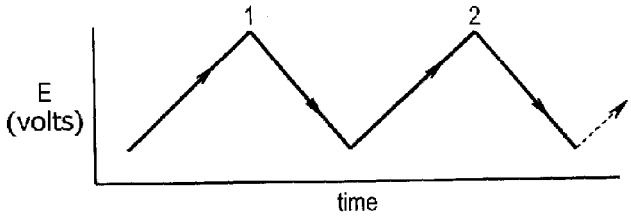
FIG. 9 illustrates another graphical representation of analytical methods that can be utilized in a method for monitoring wafer electroplating baths.
Figure 9B:
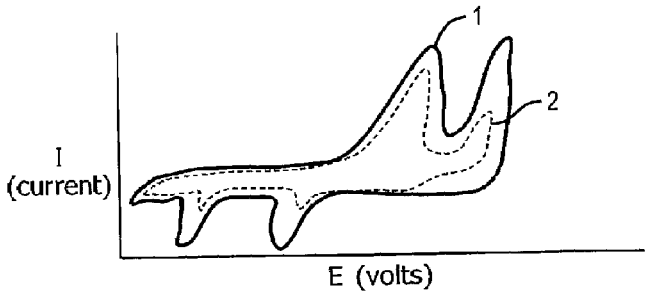

FIG. 9 illustrates another graphical representation of analytical methods that can be utilized in a method for monitoring wafer electroplating baths. Specifically, FIG. 9(*a*) illustrates voltage (E) as a function of time, and shows a generally linear pattern of alternately increasing and decreasing voltage. FIG. 9(*b*) shows two different curves for current (I) versus voltage (E), showing two different curves for current and voltage corresponding to the alternately increasing and decreasing voltage signal in FIG. 9(*a*). Peaks 1 and 2 are indicative of an electrochemical reaction or electron transfer reaction occurring on the microstructured electrode. FIG. 9 illustrates another graphical representation of an electroanalytical method, cyclic voltammetry, that can be utilized in a method for monitoring wafer electroplating baths.

Specifically, FIG. 9(*a*) illustrates the imposed voltage (E) as a function of time, which shows a generally linear pattern of alternately increasing and decreasing voltage. FIG. 9(*b*) shows two different curves for current (I) versus voltage (E), showing two different curves for current and voltage corresponding to the alternately increasing and decreasing voltage signal in FIG. 9(*a*). Peaks 1 and 2 are indicative of an electrochemical reaction or electron transfer reaction occurring on the microstructured electrode. A general discussion of the data to be expected according to the illustrations of FIGS. 9(*a*) and 9(*b*) can be found in A. J. Bard and L. R. Faulkner, Electrochemical Methods, pp. 213–215, John Wiley & Sons, 1980.

A method of monitoring wafer electroplating baths that permits in situ monitoring of the electrodeposition process during the manufacture of metallic interconnects is thereby enabled. A microstructured electrode having a patterned surface of trenches with specific geometries on a planar electrode is provided. The electrode can be a silicon wafer provided with a specific patterned surface made by microlithography, and then deposited with a copper seed layer to simulate an actual wafer to be manufactured. The microstructured electrode can also be made by providing a planar metallic electrode and micromachining it to the specific patterned surface to be desired. For instance, a stainless steel or steel flat electrode can be micromachined and then deposited with copper.

The trench dimensions (A and B) can be very small, from tenths of microns to microns in length, or larger in size, from microns to tens of microns in length. The dimensions of the trenches or patterns on the electrode can either be variable in length or of equal length. The electrode is encapsulated into a non-conductive sheath such as Teflon, with electrical connections for connecting to a power supply or potentiostat/galvanostat (FIG. 1).

Thus, as shown in FIG. 7(*a*), a typical analytical cell 50 can be used with the microstructure electrode 12. The cell 50 comprises the microstructured electrode 12, a metal anode 52 constructed of copper or an inert metal such as platinum, and a reference electrode 54 for control of the potential/current signal.

The analytical methods used to determine mass transfer of the bath components or deposition rate of the copper can be an electrochemical method such as electrochemical impedance. For examples, the electrochemical impedance method imposes a alternating current (A.C.) potential of small magnitude (20 mV) and of varying frequency, from 1 MHz up to 100 kHz. The subsequent current measured can be plotted in a Nyquist plot, as shown in FIG. 8(*a*). The Nyquist plot can provide information on the kinetics of the chemical deposition reaction as well as diffusion related characteristics. Calculation algorithms also exist to extract kinetic rate and diffusion rate parameters from the raw scan. Depending on the amount of additives or degradation products, these parameters will change and should give an indication of the quality of the bath.

One advantage of the impedance method is that copper does not have to be deposited onto the electrode surface and stripped, as in a cyclovoltammetric stripping (CVS) technique, since only a small (±20 mV) signal is applied to the electrode. Thus, maintenance of the electrode should be minimized. Also, electrochemical impedance scans can be quick, taking several minutes, as compared with mass transfer data, which can take somewhat longer at 20–30 minutes.

Other more commonly used electrochemical methods such as cyclic voltammetry or cyclic voltammetric stripping can also be used with the microstructured electrode. Again, a potential or current scan is used to deposit and then strip from the electrode. The resulting current or potential scan containing peaks where the stripping of the copper occurs will change depending on the condition of the bath, as shown in FIG. 9(*b*), curves 1 and 2.

Some references generally discussing the cyclic voltammetric stripping (CVS) method include Bratin P., Chalyt G., Pavlov M., Control of Damascene Copper Processes by Cyclic Voltammetric Stripping, Plating & Surface Finishing, March 2000, and Bratin P., Chalyt G., Kogan A., Pavlov M., Perpich J., Control of Damascene Copper Processes by Cyclic Voltammetric Stripping, Semiconductor Fabtech-12$^{th}$ Edition, 2001.

Thus, a microstructured electrode and method for monitoring wafer electroplating baths that permits in situ monitoring of the electrodeposition process during the manufacture of metallic interconnects is disclosed. While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A microstructured electrode comprising, in combination:

a patterned electrode constructed and arranged to be operatively associatable with equipment for monitoring an electrical signal;

the patterned electrode having n trenches separated by wall portions, the trenches having widths between about 0.1 microns and about 100 microns and having heights between about 0.1 microns and about 100 microns, a top surface of the wall portions having an insulating layer thereupon;

wherein n is between 1 and 1000.

2. The microstructured electrode described in claim 1, further comprising:

the trenches having widths between about 0.1 microns and about 2.0 microns.

3. The microstructured electrode described in claim 2, further comprising:

the trenches having heights between about 0.5 microns and about 20 microns.

4. The microstructured electrode described in claim 3, wherein n is between about 50 and about 200.

5. The microstructured electrode described in claim 2, wherein n is between about 50 and about 200.

6. The microstructured electrode described in claim 1, further comprising:

the trenches having heights between about 0.5 microns and about 20 microns.

7. The microstructured electrode described in claim 6, wherein n is between about 50 and about 200.

8. The microstructured electrode described in claim 1, wherein n is between about 50 and about 200.

9. A microstructured electrode comprising, in combination:

a patterned electrode constructed and arranged to be operatively associatable with equipment for monitoring an electrical signal;

the patterned electrode having n trenches separated by wall portions, the trenches having widths less than about 100 microns and having heights between about 0.1 microns and about 100 microns, a top surface of the wall portions having an insulation layer thereupon;

wherein n is less than 1000.

10. The microstructured electrode described in claim 9, further comprising:

the trenches having widths less than about 2.0 microns.

11. The microstructured electrode described in claim 10, further comprising:

the trenches having heights less than about 20 microns.

12. The microstructured electrode described in claim 11, wherein n is less than about 200.

13. The microstructured electrode described in claim 10, wherein n is less than about 200.

14. The microstructured electrode described in claim 9, further comprising:

the trenches having heights less than about 20 microns.

15. The microstructured electrode described in claim 14, wherein n is less than about 200.

16. The microstructured electrode described in claim 9, wherein n is less than about 200.

* * * * *